US007017780B2

(12) United States Patent
Renaud

(10) Patent No.: US 7,017,780 B2
(45) Date of Patent: Mar. 28, 2006

(54) TABLET DISPENSER

(75) Inventor: Michel C. Renaud, Prangins (CH)

(73) Assignee: E. I. du Pont de Nemours and Company, Wilmington, DE (US)

( * ) Notice: Subject to any disclaimer, the term of this patent is extended or adjusted under 35 U.S.C. 154(b) by 294 days.

(21) Appl. No.: 10/714,117

(22) Filed: Nov. 14, 2003

(65) Prior Publication Data

US 2004/0094566 A1 May 20, 2004

Related U.S. Application Data

(60) Provisional application No. 60/426,109, filed on Nov. 14, 2002.

(51) Int. Cl.
*B65G 59/00* (2006.01)

(52) U.S. Cl. ..... 221/263; 221/266

(58) Field of Classification Search ..... 221/263, 221/266, 277, 247

See application file for complete search history.

(56) References Cited

U.S. PATENT DOCUMENTS 6,142,337 A 11/2000 Schreckenberg et al.
6,390,328 B1 * 5/2002 Obermeier et al. ..... 221/203

* cited by examiner

*Primary Examiner*—Kenneth Noland

(57) ABSTRACT

A dispenser for storing and dispensing small items is provided. The dispenser includes a base container having an a hollow space for storing items to be dispensed, a cover sized to fit over the opening of the base container, and a wheel rotationally mounted under the cover which has a shaft and at least three fins radially extending from the shaft and spaced from each other around the shaft. The wheel is mounted under the cover such that the fins of the wheel can rotate under the cover and carry an item stored within the base container to a port in the cover. The rotating fins on the wheel are aligned so as to contact and pass over the raised boss on an inside surface of the cover each time the wheel is rotated 360 degrees. An actuator is also provided for manually rotating the wheel under the cover, which actuator is accessible from outside of the dispenser. Both the cover and the fins of the wheel are made of plastic.

17 Claims, 9 Drawing Sheets

TABLET DISPENSER

This application claims the benefit of U.S. Provisional Application No. 60/426,109 filed Nov. 14, 2002 which is incorporated by reference herein for all purposes as if fully set forth.

BACKGROUND OF THE INVENTION

1. Field of the Invention

The present invention relates to a dispenser for tablets, lozenges, candies or other small items. More particularly, the invention relates to tablet dispenser with an opening that controls the rate at which tablets are dispensed and that automatically seals the dispenser when not in use.

2. Description of the Related Art

Containers for individual tablets or candies are well known. Such dispensers generally include a removable screw top, a peelable seal, a slidable cover, or a snap-fit cap or opening. Once these closures are opened, the items within containers having such closures may be freely poured from the container. Containers for tablets or candies exist that include closures that control the rate at which tablets are dispensed from the container. U.S. Pat. No. 6,142,337 discloses a tablet dispenser with a built-in mechanism for dispensing one tablet at a time. The feeding and dispensing mechanism of the tablet dispenser of U.S. Pat. No. 6,142,337 takes up a substantial portion of the space within the dispenser so as to leave less storage space for the items to be dispensed. In addition, the dispenser of U.S. Pat. No. 6,142,337 can be used for items of just one size, so as to require a separate design and structure for each different size item to be dispensed. Finally, the dispensing mechanism of the tablet dispenser of U.S. Pat. No. 6,142,337 is so completely integrated with the overall container that there is little flexibility to change the shape and size of the container without also requiring a complete redesign of the dispensing mechanism, with the consequent retooling of the molds used to produce the dispensing mechanism.

There is a need for a tablet or candy dispenser having a closure that seals a tablet container and also facilitates the controlled discharge of tablets from the container. There is a further need for a dispenser having a closure that can be hand actuated to dispense items wherein the position of the closure can be readily sensed by the hand that is actuating the dispenser. There is a further need for a flexible tablet dispenser that is capable of dispensing items of a variety of sizes and that can be readily incorporated into dispensers with a variety of shapes and storage capacities. Finally, there is a need for a dispenser having a dispensing closure that can be economically produced and can be readily connected to the container portion of the dispenser.

SUMMARY OF THE INVENTION

The present invention is directed to a dispenser for storing and dispensing small items. The dispenser includes a base container having a hollow space for storing items to be dispensed, and having an opening connected to the hollow space. The dispenser also includes a cover sized to fit over the opening of the base container, the cover having a port through which items stored in the base container can be dispensed, and at least one raised boss on an inside surface of the cover. The cover may be attached over the opening of the base container by adhesives, tapes or a mechanical connection. The dispenser further includes a wheel rotationally mounted under the cover which has a shaft and at least three fins radially extending from the shaft and spaced from each other around the shaft. The wheel is mounted under the cover such that the fins of the wheel can rotate under the cover and carry an item stored within the base container to the cover port. The rotating fins on the wheel are aligned to contact and pass over the raised boss on the inside surface of the cover each time the wheel is rotated 360 degrees. The dispenser of the invention also includes an actuator for manually rotating the wheel under the cover, which actuator is accessible from outside of the dispenser. Both the cover and the fins of the wheel are made of plastic.

According to a preferred embodiment of the invention, the cover port has a first edge under which the wheel fins first pass each time one of the fins is rotated past the cover port and a second edge under which the wheel fins last pass each time one of the fins is rotated past the cover port. The cover further includes a first raised boss on an inside surface of the cover proximate the first port edge and a second raised boss on an inside surface of the cover proximate the second port edge. The wheel is mounted under the cover such that the fins of the wheel contact and pass over the first and second raised bosses on the inside surface of the cover each time the wheel is rotated 360 degrees.

DETAILED DESCRIPTION OF THE INVENTION

Figure 1:
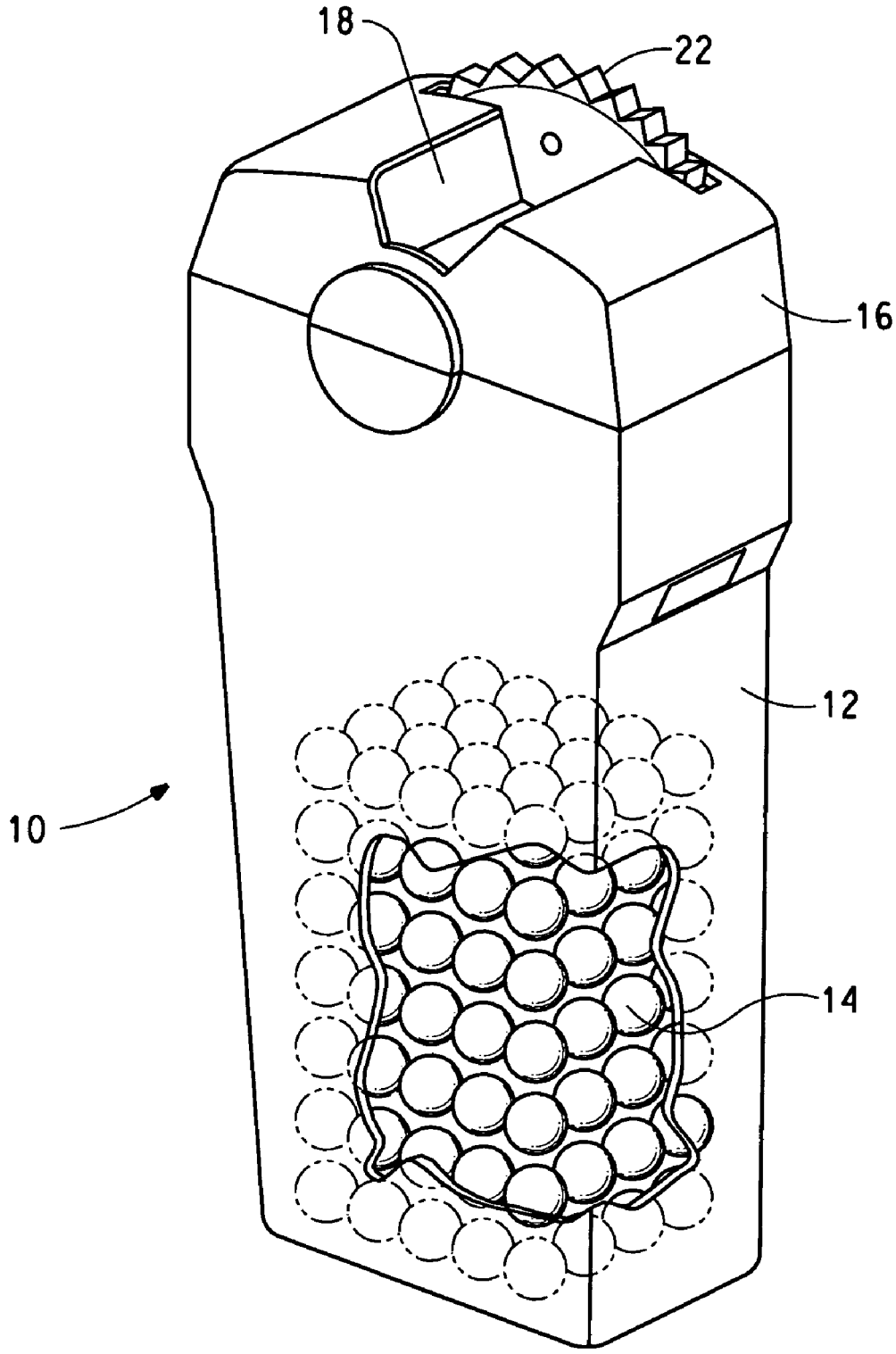
FIG. 1 is a perspective of the tablet dispenser according to a preferred embodiment of the invention.

One preferred embodiment of the dispenser of the invention is shown in FIG. 1. The dispenser 10 acts as a container for tablets, pills, candies, lozenges, pellets, beads, or other such relatively small items. Dispenser 10 includes a hollow base container 12 that stores the tablets 14 or other small items to be dispensed. The base container 12 has a cover 16 that fits over an opening in the base container 12 and that can be readily attached to the base container 12. The cover 16 includes a self-closing opening 18 that can be controlled by a manual actuator such as the rotating teeth 22 that can be seen in FIG. 1.

Figure 2:
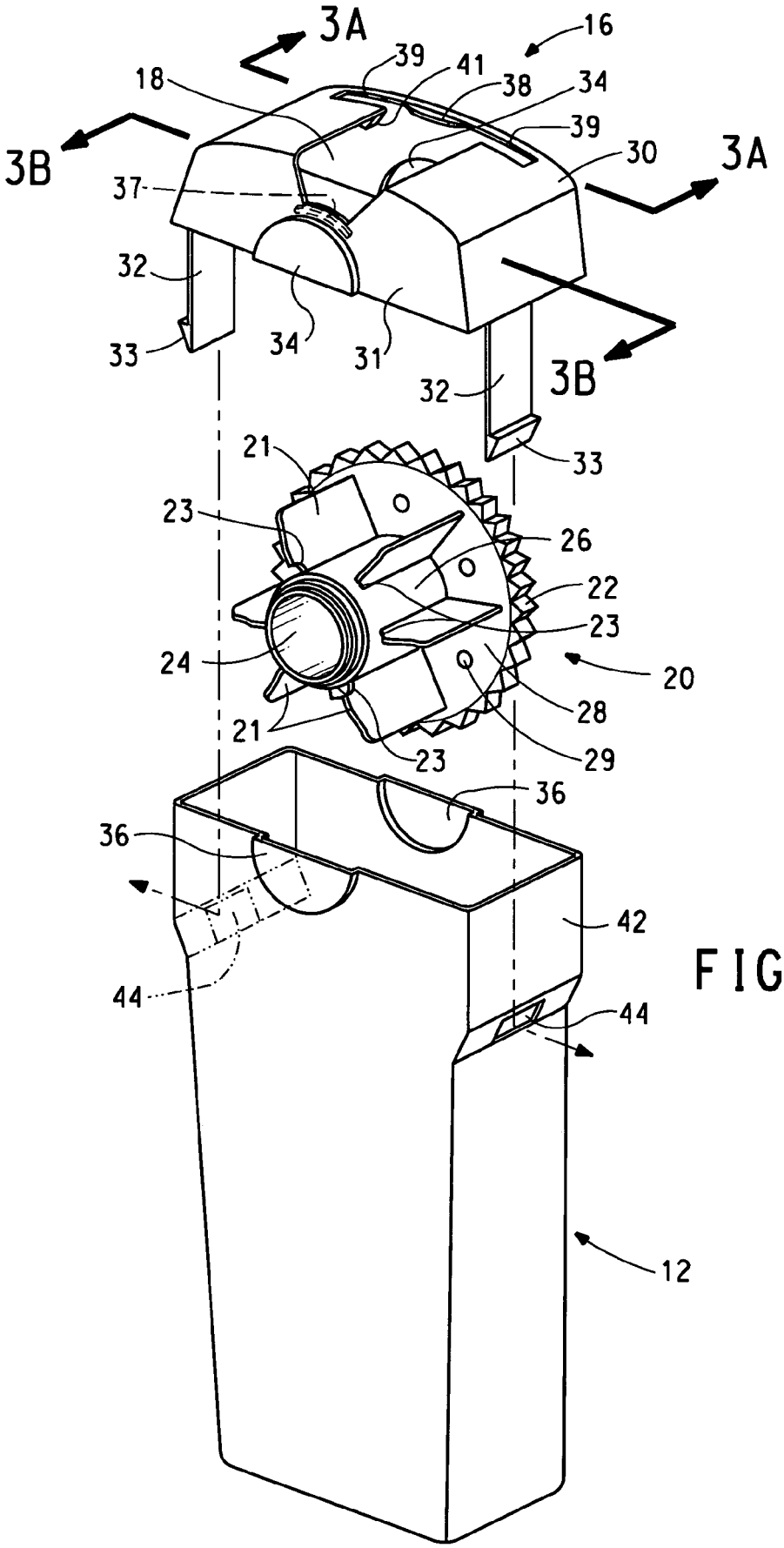
FIG. 2 is an exploded perspective view of the dispenser shown in FIG. 1.

The dispenser of the preferred embodiment of the invention can be better seen in FIG. 2. The three primary elements of the dispenser are the hollow base container 12, the cover 16, and a rotationally mounted wheel 20. The cover 16 preferably has a top portion 30 and opposite side walls 31. The top cover 16 has an opening or port 18 through which items stored within the hollow base container 12 can be dispensed. In the preferred embodiment of the invention shown in FIG. 2, the opening port includes an extended slot 39 proximate one of the side walls 31 through which a section of the outer teeth 22 on the wheel 20 can extend above the top portion 30 of the cover 16.

The cover of the dispenser of the invention may be attached over the opening of the base container by any one of a variety of mechanisms including adhesives, tapes, or mechanical interlocking elements. In the embodiment of the invention shown in FIG. 2, the cover 16 is connected to an opening portion 42 of the base container 12 by means of the locking feet 32. The locking feet 32 are formed with outwardly extending tabs 33 that slide through and engage the openings 44 on opposite sides of the base container 12 when the cover 16 is pressed onto and over the opening of the base container 12.

According to the invention, the cover further includes a bearing in which the wheel 20 can be rotationally mounted. In the embodiment of the invention shown in FIG. 2, the bearing for rotationally supporting the wheel 20 is comprised of the semicircular protruding portions 34 formed in each of the side walls 31 of the dispenser cover 16. The bearing for the wheel 20 may further include complementary protruding semicircular portions 36 on opposite sides of the opening 42 of the base container 12.

The wheel 20 of the dispenser of the invention is preferably comprised of a shaft and at least three fins that radially extend from the shaft. More preferably, the wheel includes at least five fins radially extending from the shaft and spaced from each other around the shaft, and most preferably, the wheel includes six to ten fins radially extending from the shaft which fins are substantially equally spaced from each other around the shaft. In the preferred embodiment of the invention shown in FIG. 2, the wheel 20 is made with fins 21 that radially extend from the shaft 26. The fins 21 are preferably spaced and sized so as to accommodate a desired quantity of the items being dispensed. The opposite ends of the shaft 26 are preferably formed with protruding hubs 24 that are held within the bearing formed by the semicircular protruding portions 34 and 36 in the walls of the cover 16 and base container 12. In the preferred embodiment of the invention, the wheel further includes a disc-shaped end cap 28 with a serrated edge that forms the wheel teeth 22. The end cap 28 may be provided with alignment holes 29 that can be used to position the wheel 20 in the desired position during the assembly process. When the wheel 20 is mounted within the cover 16, it can be manually rotated by pushing the teeth 22 that extend through the elongated slot 39 in the cover 16.

Figure 3A:
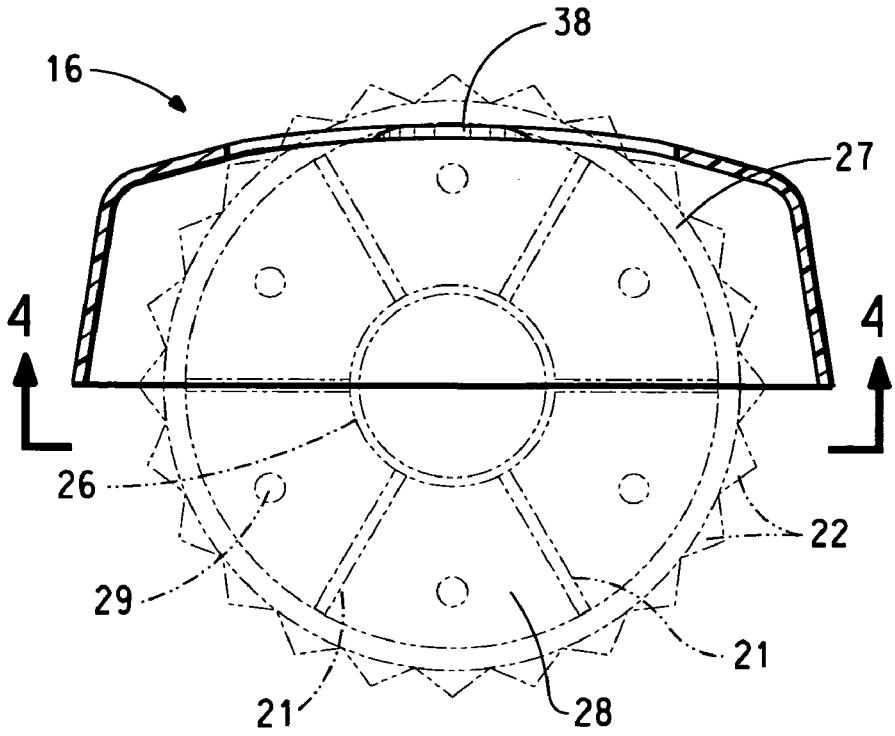
FIG. 3A is a cross-sectional view of a portion of the cover of the dispenser shown in FIG. 2, taken along the line 3A—3A.
Figure 4:
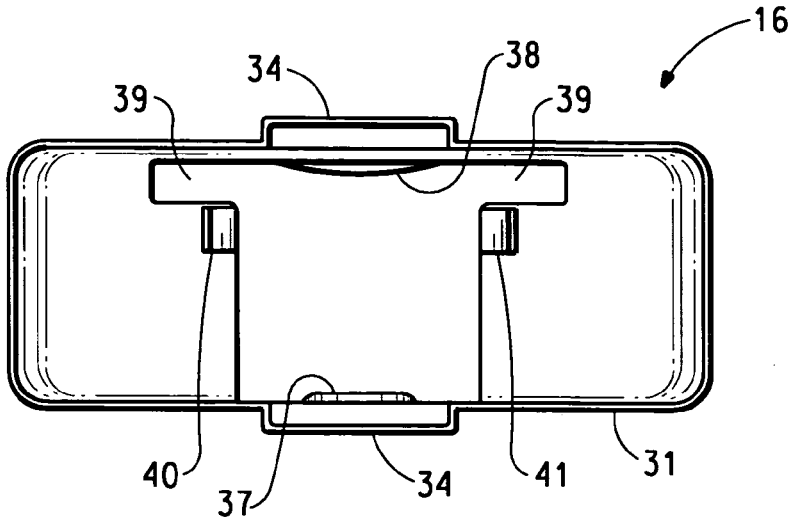
FIG. 4 is a plan view of the underside of the cover of the dispenser shown in FIGS. 3A and 3B.

According to the embodiment of the invention shown in FIG. 2, the wheel 20 can be inserted into and engaged by the cover 16 while still being rotatable within the cover 16. Preferably, wheel 20 snap fits into the cover 16 such that the cover 16 and wheel 20 can be pre-assembled prior to attaching the cover 16 on the open end of a filled base container 12. The wheel 20 is held in place within the cover 16 by the raised ridges 37 and 38 on opposite inside surfaces of the side walls 31 of the cover 16. As can be seen in FIGS. 2 and 4, the ridge 38 is proximate the slot 39 and protrudes from the inside surface of the side wall 31 next to where the slot 39 is formed in the top surface 30 of the cover 16. As best seen in FIG. 3A, the surface of the disc-shaped cap 28 facing away from the fins 21 is preferably formed with a lip 27 running around the outside surface of the cap 28 just to the inside of the teeth 22, which lip rides over the protruding ridge 38 when the wheel is inserted into the cover 16. The raised ridge 37, on the opposite side of the cover 16 engages the side of the wheel 20 opposite the cap 28. As can be seen in FIG. 2, the edge of each of the fins 21 next to the shaft 26 each have a notch 23 that engages the raised ridge 37 on the inside side wall 31 of the cover 16. Preferably, the raised ridge 37 is long enough so as to engage the notch 23 of at least one of the fins 21 at any given time.

Figure 3B:
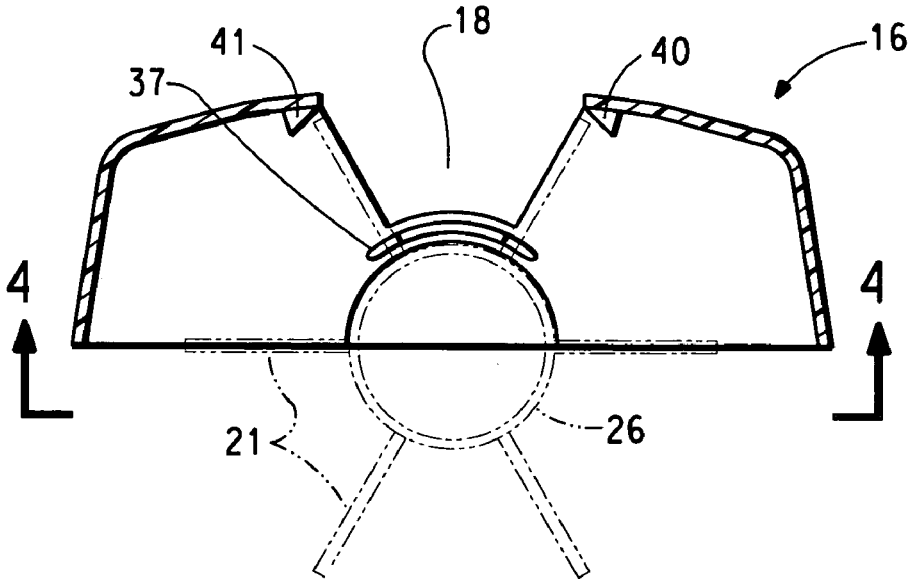
FIG. 3B is a cross-sectional view of a portion of the cover of the dispenser shown in FIG. 2, taken along the line 3B—3B.

The underside of the top surface 30 of the cover 16 has one or more raised bosses that engage the fins of the wheel 20. In the embodiment of the invention shown in FIGS. 3B and 4, a first raised boss 40 and a second raised boss 41 protrude from the underside of the cover 16 on opposite sides of the port 18. The bosses 40 and 41 should protrude far enough so as to contact the ends of the fins 21 of the rotating wheel 20. In the preferred embodiment of the invention shown in FIG. 3B, the fins 21 are each spaced from each other by the same angle which angle is wide enough so that the end edges of two adjacent fins are spaced from each other by an amount that is substantially the same as the width of the port 18. Preferably, the bosses 40 and 41 are adjacent the ends of the fins 21 so as to hold the fins to a position where one fin is lined up with one edge of the port 18 of the cover 16 and the other fin is lined up with an opposite edge of the port 18. The bosses 40 and 41 are preferably located at points on the cover where the cover is able to bend when one of the wheel fins is passing over one of the bosses. The angle of each side of the bosses may be made sharper or more gradual depending on the desired resistance against turning of the wheel 20 and the desired clicking sound as the wheel fins 21 pass over the bosses 40 and 41.

The cover 16 and the wheel 20 of the dispenser of the invention are preferably made of plastic and they are preferably produced by injection molding. The cover 16 and wheel 20 should each be made of a strong plastic that can easily slide over itself. Such a material permits the end edges of the blades 21 of the wheel 20 to pass over the bosses 40 and 41 without breaking. A strong and rigid plastic also improves the snap fit of the wheel within the cover 16. Use of a plastic with low friction properties permits the wheel 20 to turn more easily within the cover 16. One preferred polymer resin for the cover 16 and the wheel 20 is an acetal resin such as Delrin® acetal resin sold by E.I. du Pont de Nemours and Company. Other polymer resins that may be used in making the cover 16 and wheel 20 include polyamide, polybutylene terephthalate (PBT), polyethylene terephthalate (PET), other polyesters, polycarbonate, acrylonitrile-butadiene-styrene copolymer (ABS), and polyolefin. In one preferred embodiment of the invention, the wheel 20 may be molded from more than one polymer, such as a soft and flexible copolyether ester elastomer for the teeth 22 and a strong and rigid acetal resin for the remaining parts of the wheel 20.

The base container 12 may be comprised of a wider variety of materials including lightweight plastics, papers and cardboard materials. Preferred materials include polypropylene and polyethylene due to their low cost and their ability to be molded into a wide variety of shapes. While the base container 12 shown in FIG. 2 has a generally rectangular shape, it is contemplated that the base container can be molded in a wide variety of shapes and sizes so as to enhance the marketing of the items to be dispensed from the dispenser.

When the dispenser 10 shown in FIGS. 1–4 is operated, the base container 12 of the dispenser holds tablets, candies, mints, pills or other items to be dispensed. When the user of the dispenser would like to dispense tablets or other items, the dispenser is turned over and the teeth 22 extending through the slot 39 in the cover 16 are manually rotated until one or more tablets are carried between two of the fins 21 of the wheel 20 to the port 18 in the cover 16. The tablets or other items can then drop through the port 18 into the free hand of the user or onto any surface. Advantageously, the wheel can be turned in either a clockwise or counterclockwise direction, which makes the dispenser easy to operate by both right and left handed users. After the item has been dispensed, the fins 21 of the wheel 20 that are on opposite sides of the port 18 are held in a fixed position by the bosses 40 and 41 so as to keep the tablets or other items within the dispenser from spilling out of the dispenser. The angle between the fins and the length of the fins can be designed and set so as to create a volume between each set of fins such that the desired size and number of the tablets or other items are dispensed with each turn of the wheel 20 and with each click of the fins 21 passing over one of the bosses 40 or 41. With the dispenser of the current invention, the wheel, fins and cover can be designed with relatively large compartments between fins so a to accommodate variety of item sizes or number of the items to be dispensed with each turn of the wheel. Alternatively, the compartments can be made smaller and of a size very close to the size of the items being dispensed such that the dispenser will dispense just one item with each rotational click of the wheel 20.

Figure 5:
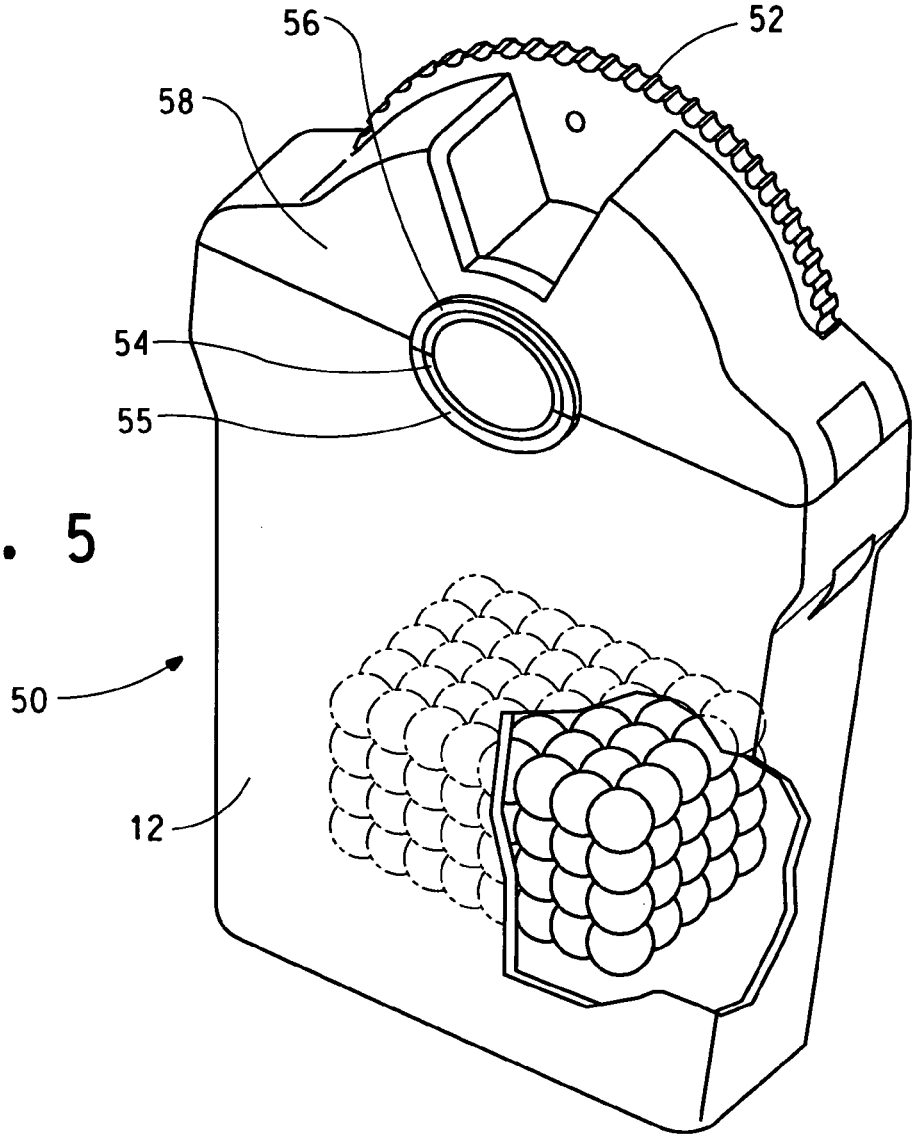
FIG. 5 is a perspective of the tablet dispenser according to another preferred embodiment of the invention.
Figure 6:
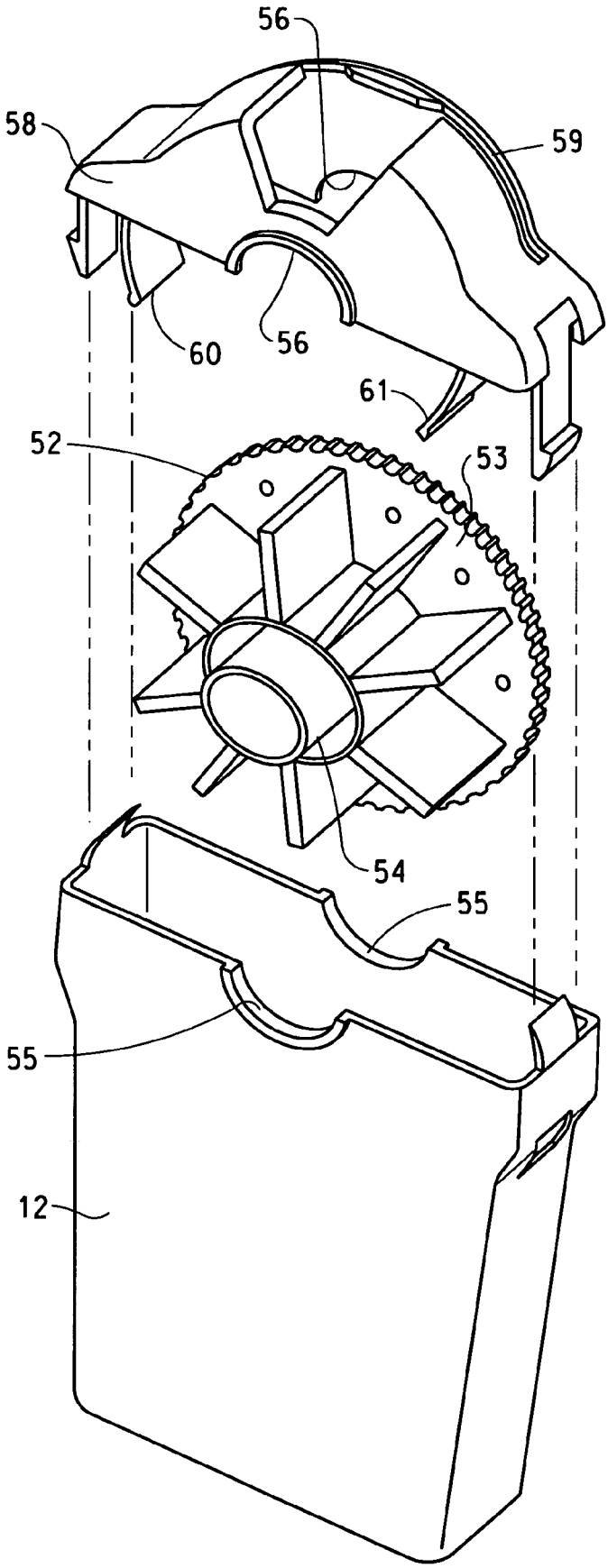
FIG. 6 is an exploded perspective view of the dispenser shown in FIG. 5.
Figure 7:
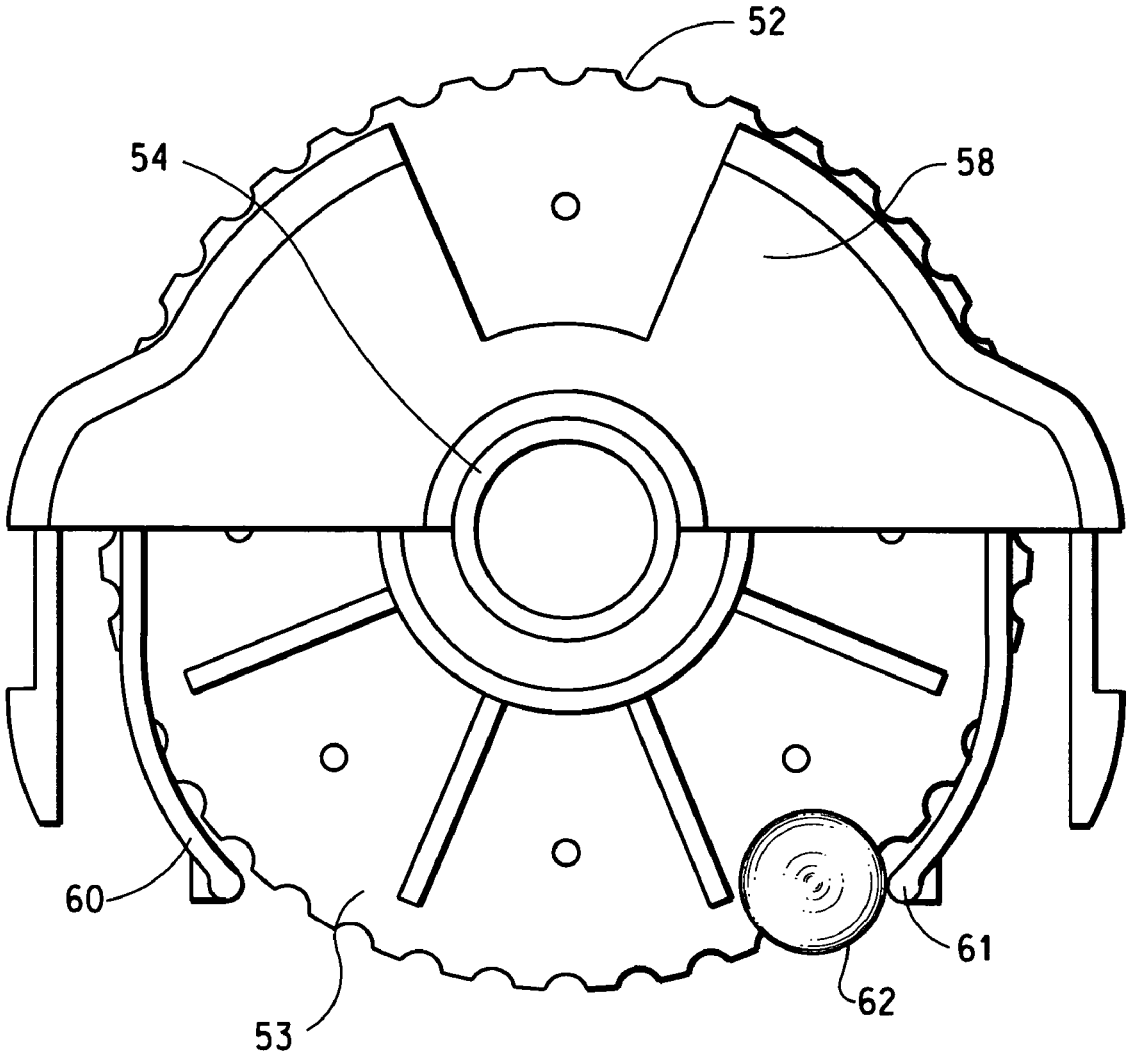
FIG. 7 is a side vide of the cover and wheel of the dispenser shown in FIG. 6.

Another preferred embodiment of the invention is shown in FIGS. 5–7. The dispenser 50, shown in FIGS. 5–7 is, in most regards, like the dispenser described above with regard to FIGS. 1–4. One notable difference in the dispenser 50 of FIGS. 5–7 is that the wheel hub 54 extends through the side walls of the opposite sides of the dispenser cover 58 and the dispenser container 12. Rounded bearing surfaces 55 on the dispenser container 12 and bearing surfaces 56 on the dispenser cover 58 support the hubs 54 on the opposite end of the central shaft of the rotatable wheel 53. A second notable difference of the dispenser shown in FIGS. 5–7 is that the outer teeth 52 on the wheel 53 protrude through the slot 59 of the cover 58 for a greater portion of the arc of the wheel than the teeth of the dispenser shown in FIGS. 1–4 so as to better facilitate actuation.

A third notable difference in the dispenser of the embodiment of FIGS. 5–7 is the flexible guide arms 60 and 61 that are integral with and extend down from the cover 58. The guide arms 60 and 61 serve to regulate the flow of tablets or candies into the spaces between the fins of the wheel 53 and around the wheel 53 so as to prevent an overload of tablets or candies from jamming the wheel. The arms 60 and 61 are made both strong and flexible so that excess tablets between the fins of the wheel can escape from between the wheel fins without breaking the arms. For this reason, it is beneficial if the cover 58 and the arms 60 and 61 are molded from a high strength plastic such as an acetal resin.

Figure 8:
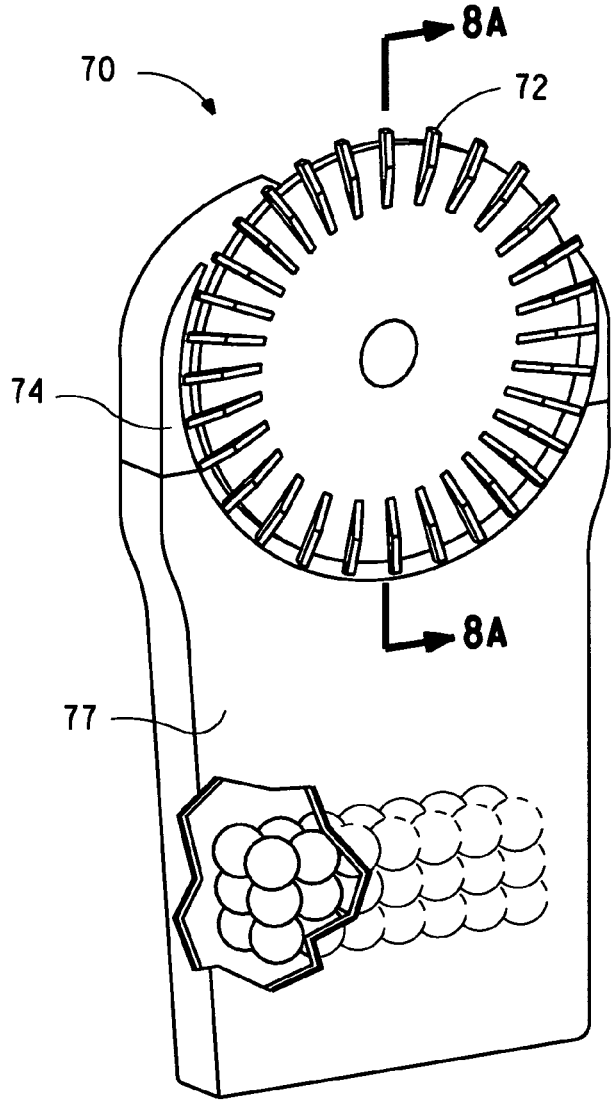
FIG. 8 is a perspective of the tablet dispenser according to another preferred embodiment of the invention.
Figure 8A:
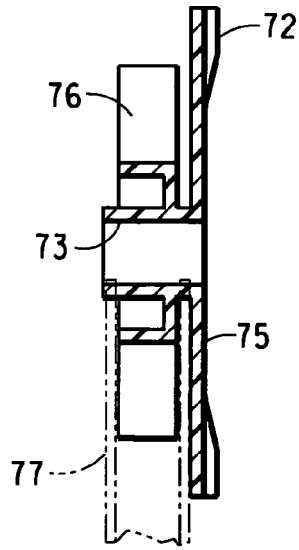
FIG. 8A is a cross-sectional view taken along the line 8A—8A of FIG. 8.
Figure 9:
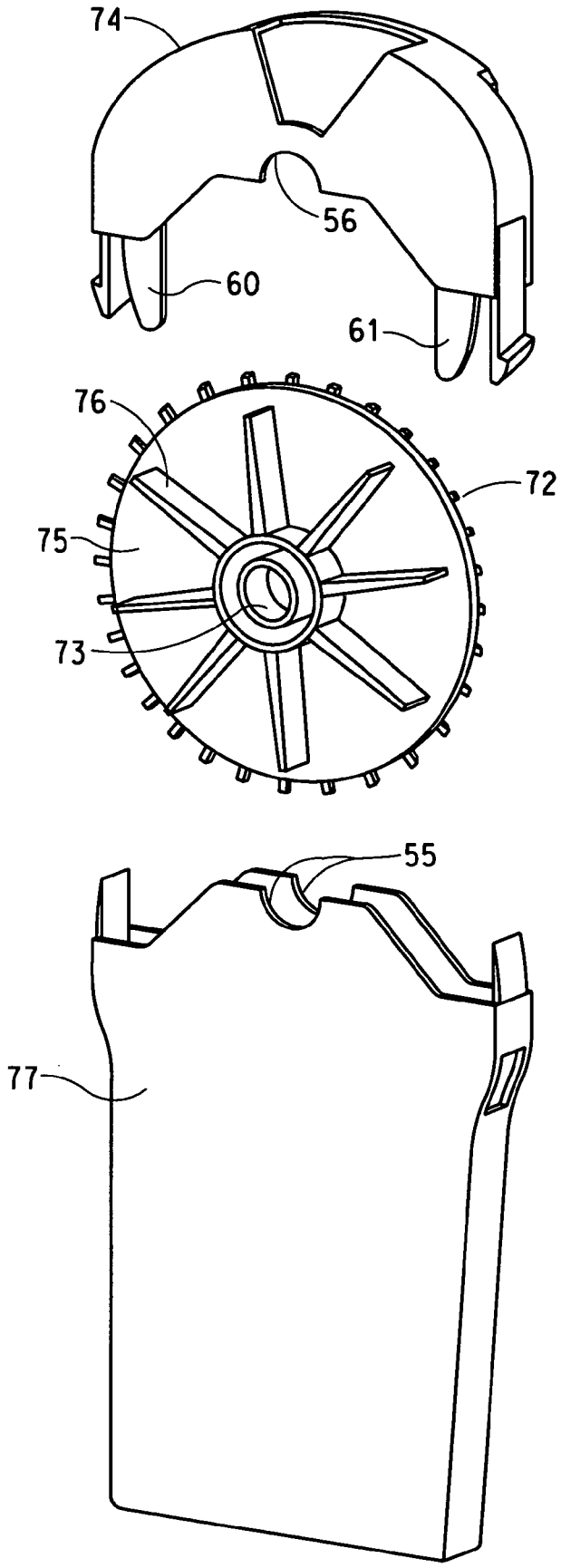
FIG. 9 is an exploded perspective view of the dispenser shown in FIG. 8.
Figure 10:
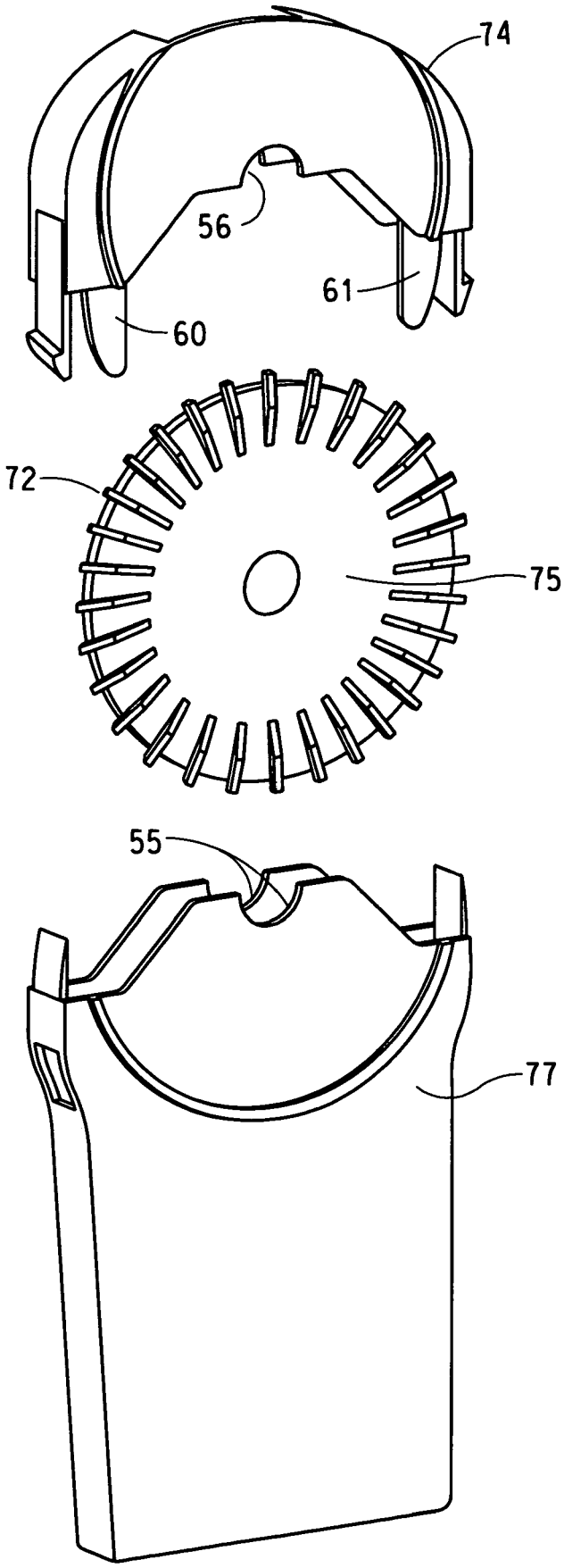
FIG. 10 is an exploded perspective view of the opposite side of the dispenser shown in FIG. 9.

Another preferred embodiment of the invention is shown in FIGS. 8–10. The dispenser 70, shown in FIGS. 8–10 is, in most regards, like the dispenser described above with regard to FIGS. 5–7. The notable difference in the dispenser 70 of FIGS. 8–10 is that the wheel includes an actuation disc 75 that is located entirely outside of the container 77 and cover 74. As best seen in FIG. 8A, the actuation disc 75 is mounted on or integral with the wheel shaft 73, but is offset from the fins 76 that also extend from the wheel shaft 73. When the wheel is mounted within the dispenser 70, the wheel shaft 73 is held by the rounded bearing surfaces 55 on the container 77 and the corresponding bearing surfaces 56 on the cover 74. When a user wants to dispense a tablet or candy from the dispenser 70, the user simply turns the dispenser upside down and positions the port in the cover 74 over a hand or other surface where the item is to be dispensed. The user is then able to push against the ribs 72 on the actuation disc 75 so as to turn the fins 76 on the wheel until the desired number of items are dispensed through the port.

Although a particular embodiment of the present invention has been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification and drawings, as indicating the scope of the invention.

What is claimed is:

1. A dispenser for storing and dispensing small items, comprising:

a base container having an a hollow space for storing items to be dispensed, and having an opening connected to the hollow space;

a cover sized to fit over the opening of the base container, said cover having a port through which items stored in the base container can be dispensed, and at least one raised boss on an inside surface of the cover;

means for attaching the cover over the opening of the base container;

a wheel rotationally mounted under the cover, said wheel having a shaft and at least three fins radially extending from the shaft and spaced from each other around the shaft, said wheel being mounted under the cover such that the shaft and the fins of the wheel can rotate under the cover and carry an item stored within the base container to the cover port, said rotating fins being aligned to contact and pass over the raised boss on the inside surface of the cover each time the wheel is rotated 360 degrees;

an actuator for manually rotating the wheel under the cover, said actuator being accessible from outside of the dispenser;

said cover and wheel fins being made of plastic resin.

2. The dispenser of claim 1, wherein the cover port has a first edge under which the wheel fins first pass each time one of the fins is rotated past the cover port and a second edge under which the wheel fins last pass each time one of the fins is rotated past the cover port, and wherein the cover includes a first raised boss on an inside surface of the cover proximate the first port edge and a second raised boss on an inside surface of the cover proximate the second port edge, said wheel being mounted under the cover such that the fins of the wheel contact and pass over the first and second raised bosses on the inside surface of the cover each time the wheel is rotated 360 degrees.

3. The dispenser of claim 2, wherein said cover has opposite side walls and the inside surface of each of said side walls has a raised ridge, and wherein the wheel includes opposite corresponding sides that each include concave portions that are complimentary to the raised ridges on the opposite side walls of the cover, such that the wheel can be snapped into and held by the cover while still being rotatable within the cover.

4. The dispenser of claim 3, wherein the shaft of the wheel includes first and second opposite ends that each have a hub, and wherein the side walls of the cover each include a bearing on which the shaft hubs are mountable for rotation.

5. The dispenser of claim 4, wherein each side wall of the cover includes an indented portion that acts as a bearing for a hub of the shaft of the wheel.

6. The dispenser of claim 5, wherein the base container includes opposite side walls that are aligned with opposite side wall of the cover, and wherein each of the side walls of the base container includes an indented portion that acts as a portion of the bearing for a hub of the shaft of the wheel.

7. The dispenser of claim 1, wherein the wheel includes at least five fins radially extending from the shaft and spaced from each other around the shaft.

8. The dispenser of claim 2, wherein the wheel includes six to ten fins radially extending from the shaft, said fins being substantially equally spaced from each other around the shaft.

9. The dispenser of claim 8, wherein each of the fins has an end edge that is substantially parallel to the axis of the shaft and is on the edge of the fin furthest from the shaft, and wherein the end edges of adjacent fins are spaced from each other by a distance substantially equal to the distance between the first and second edges of the cover port.

10. The dispenser of claim 1, wherein the actuator for manually rotating the wheel under the cover comprises a disc axially mounted on the shaft, said disc having an outer edge that projects through a slot in said cover, said disc engaging the wheel shaft such that manually moving the edge of said disc rotates the fins on the wheel.

11. The dispenser of claim 10 wherein the disc axially mounted on the shaft is located entirely outside of said cover.

12. The dispenser of claim 1 wherein the cover includes at least two flexible arms extending from the cover on opposite sides of the wheel rotationally mounted under the cover.

13. The dispenser of claim 1, wherein the cover and the fins of the wheel are comprised of at least 80% by weight of polymer from the group of acetal, polyamide, polyester, polycarbonate, polyolefin and acrylonitrile-butadiene-styrene polymer and copolymer resins and blends thereof.

14. The dispenser of claim 13, wherein the cover and the fins of the wheel are comprised of at least 80% by weight of acetal polymer resin.

15. The dispenser of claim 10, wherein the wheel is comprised of at least two polymer or copolymer resins, wherein the fins of the wheel are comprised of at least 80% by weight of a rigid plastic selected from the group of acetal, polyamide, polyester, polycarbonate, and acrylonitrile-butadiene-styrene polymer and copolymer resins, and wherein the outer edge of the disc is comprised of a softer and more flexible polymer or copolymer resin.

16. The dispenser of claim 15, wherein the outer edge of the disc is comprised of at least 80% by weight of a thermoplastic copolyether ester.

17. The dispenser of claim 1, wherein the means for attaching the cover over the opening of the base container is selected from the group of adhesives, tapes, and mechanical interlocking elements.

* * * * *